US012616880B1

(12) United States Patent
Wilkins

(10) Patent No.: US 12,616,880 B1
(45) Date of Patent: May 5, 2026

(54) TRIUNE QUICK RELEASE ASSEMBLY AND CONNECTION GOLF CLUB SYSTEM

(71) Applicant: J.T. Wilkins, Colorado Springs, CO (US)

(72) Inventor: J.T. Wilkins, Colorado Springs, CO (US)

( * ) Notice: Subject to any disclaimer, the term of this patent is extended or adjusted under 35 U.S.C. 154(b) by 756 days.

(21) Appl. No.: 17/992,087

(22) Filed: Nov. 22, 2022

Related U.S. Application Data

(63) Continuation-in-part of application No. 15/057,346, filed on Mar. 1, 2016, now abandoned.

(60) Provisional application No. 62/177,034, filed on Mar. 6, 2015.

(51) Int. Cl.
*A63B 53/02* (2015.01)

(52) U.S. Cl.
CPC ..... *A63B 53/02* (2013.01)

(58) Field of Classification Search
CPC .... A63B 53/02; A63B 2210/50; Y10T 403/40
See application file for complete search history.

(56) References Cited

U.S. PATENT DOCUMENTS

| | | | | |
|---|---|---|---|---|
| 4,859,110 | A * | 8/1989 | Dommel | F16D 1/116 403/328 |
| 2007/0249430 | A1* | 10/2007 | Churovich | A63B 53/00 473/316 |
| 2011/0118044 | A1* | 5/2011 | Sato | A63B 60/00 473/307 |
| 2016/0256752 | A1* | 9/2016 | Wilkins | A63B 53/02 |

* cited by examiner

*Primary Examiner* — Michael D Dennis
(74) *Attorney, Agent, or Firm* — Head, Johnson, Kachigian & Wilkinson, PC

(57) ABSTRACT

A triune quick release assembly and connection golf club system is disclosed herein. The quick release golf club has an improved assembly, disassembly, and connection between the club shaft to allow the golfer to effortlessly change the club grip and/or club head. The triune quick release assembly and connection golf club system includes a quick release connection between the club shaft and the club grip, and also includes a quick release connection between the club shaft and the club head.

9 Claims, 5 Drawing Sheets

TRIUNE QUICK RELEASE ASSEMBLY AND CONNECTION GOLF CLUB SYSTEM

CROSS REFERENCE TO RELATED APPLICATIONS

This application claims priority to and the benefit of U.S. patent application Ser. No. 15/057,346 filed Mar. 1, 2016 and U.S. Provisional Patent Application Ser. No. 62/177,034, filed Mar. 6, 2015, which are incorporated herein in their entireties.

BACKGROUND OF THE INVENTION

1. Field of the Invention

This invention relates generally to a triune quick release assembly and connection golf club system, and more particularly, but not by way of limitation, to a quick release golf club with an improved assembly, disassembly, and connection with the club shaft to allow the golfer to effortlessly change the club grip and/or club head.

2. Description of the Related Art

Golf is a popular game played worldwide by professionals and amateurs. It requires a great deal of concentration and precision. Since its inception, golf equipment manufacturing has evolved into a highly technical field. The two main pieces of equipment needed are a golf club and a golf ball. The golf club is probably the most important piece of equipment needed to master the game. A club consists of three components: the head, the shaft, and the grip. The head of the club, also called the "wood" or "iron" is located at the bottom of the shaft and the grip is located at the top. Today, most heads are made using advanced materials such as titanium, graphite, and zirconia. With so many technological capabilities, there are a number golf component parts available today. There are also multiple club variations such as in the loft angle, lie angle, offset features, and weighting.

Club heads can be combined with different shafts based on flex or kick points for example. Considering the available variations in shafts and club heads, there are literally hundreds of different club head/shaft combinations available to the golfer. A club fitter can assist the golfer with the best combination for his swing characteristics and needs. Traditional golf heads were permanently mounted to shafts using cements or adhesives. Therefore, to enable a golfer to test a variety of head/shaft combinations, the golfer had to carry several combinations of clubs, which are heavy and take up a lot of space.

The rules of golf require players to utilize fourteen (14) clubs during the game. However, carrying this number of standard clubs can be cumbersome. Customization of golf clubs will always be a compelling need for a golfer regardless of his skill level. Golfers need to make a quick decision as to what type of iron they are going to use for the next shot. There is a definite need for a golfer to be able to use the shaft he is most comfortable with and quickly change the iron/wood or grip based on his preference. In addition, golfers have a limited time to make the next shot and often times the pins and release tools of prior golf clubs are difficult to align and lock thereby causing delay. Some release tools require several minutes to align, insert, and lock which may cause frustration for the golfer, thereby causing him to lose his concentration for the next shot.

With the game of golf becoming more and more popular each year, golfers of any skill level will demand a customized full set of clubs that are easily transportable, yet offer the same functionality as a weighty and cumbersome traditional 14-bag set. Standard clubs, however, cannot fit in the overhead compartments on airplanes. Therefore, the traveling golfer would benefit from a compact carrying case which holds a standard shaft (driver), a standard putter, two grips: one for the driver and one for the putter; and preference as to the number of woods, irons, and wedges to form a complete set.

Notwithstanding, in an already crowded field of golf clubs with quick release heads and grips, there exists a continuing need for a new and improved golf club assembly and disassembly to easily and quickly change the desired head and grip, while offering travel portability.

It is therefore desirable to provide a quick release golf club with an improved assembly, disassembly, and connection with the club shaft to allow the golfer to effortlessly change the club grip and/or club head.

It is further desirable to provide a triune quick release assembly and connection golf club system that does not utilize pins, screws or release tools like the latest clubs on the market, because such adaptations are not necessarily as "quick" as claimed.

It is still further desirable to provide a triune quick release assembly and connection golf club system that is invaluable to the business traveler who desires to use personal yet portable clubs when he travels, because the weight and bulk of common design standard golf bags along with a full set of clubs are extremely cumbersome when navigating through airports.

Other advantages and features of the invention will be apparent from the following description and from the claims.

BRIEF SUMMARY OF THE INVENTION

In general, the invention relates to a triune quick release connection system for a golf club, where the golf club includes a club grip, a club head, and a club shaft intermediate of the club grip and the club head. The triune quick release connection system may include a first quick release connection between an upper terminal end of the club shaft and a lower terminal end of the club grip and a second quick release connection between a lower terminal end of the club shaft and a hosel of the club head. The first quick release connection may comprise: a tapered engagement insert with a shape capable of preventing rotation when engaged; a spring-loaded spherical ball engagement; and a rotational locking twist knob. The second quick release connection may comprise: a tapered engagement insert with a shape capable of preventing rotation when engaged; a spring-loaded spherical ball engagement; and a locking ring.

The tapered engagement insert of the first quick release connection may have a multi-conic shape and/or the engagement insert of the second quick release connection may have a square shape.

The first quick release connection may further comprise a shaft-side engagement piece with a shape that is the mating inverse of the tapered engagement insert, where the shaft-side engagement piece is connected to the club shaft, and an internal draw rod with a lower threaded section capable of drawing the tapered engagement insert and the shaft-side engagement piece together. The first quick release connection may further comprise a coupler, where a top section of the internal draw rod is capable of passing through the coupler and being retained with a clip ring. The spring-loaded spherical ball engagement may comprise one or more springs and one or more balls and the second quick release connection may further comprise detents in a top face of the coupler, where the detents are capable of receiving the one or more balls, and an end plate capable of retaining the one or more balls and the one or more springs within the rotational locking twist knob against the detents.

The spring-loaded spherical ball engagement may comprise one or more springs and one or more balls and the second quick release connection may further comprise a post bonded into the club shaft, where the post terminates in the tapered engagement insert, a shoulder, and a retainer ring capable of being threaded onto the post to capture the one or more springs and the one or more balls between the retainer ring and the shoulder. The second quick release connection may further comprise a socket with an interior that corresponds to the tapered engagement insert of the post, such that the tapered engagement insert is capable of being received within the socket such that post cannot rotate, and a locking ring capable of being rotated until the socket and post are captured, such that the balls are engaged into detents on the retainer ring and the springs prevent the retaining ring from turning. The second quick release connection may further comprise a compression disk and slip ring. The head insert may be bonded to the club head.

DETAILED DESCRIPTION OF THE INVENTION

Figure 1:
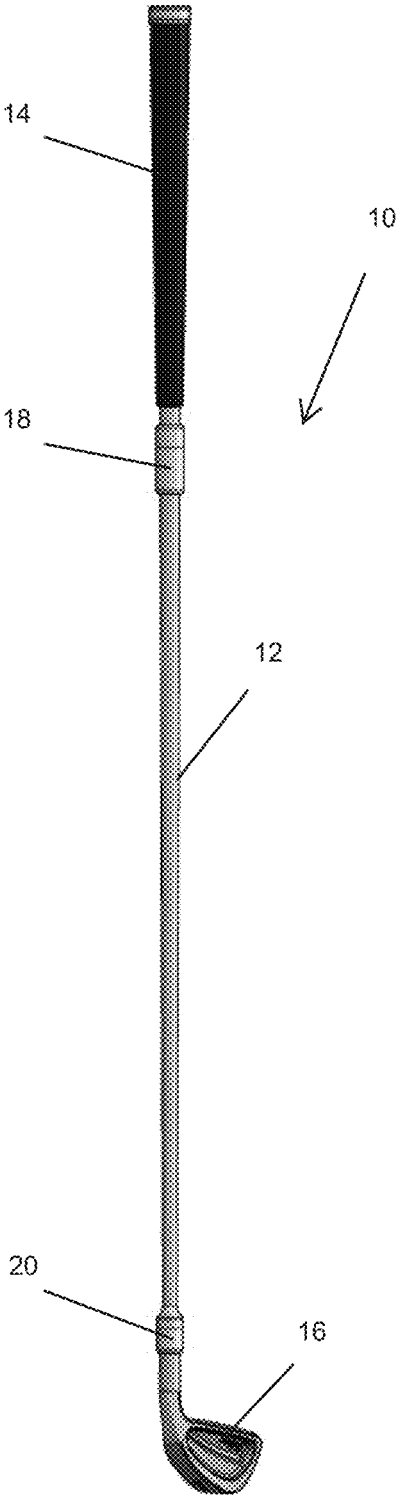
FIG. 1 is a perspective view of a golf club having a triune quick release assembly and connection between the club shaft and the club grip and between the club shaft and the club head in accordance with an illustrative embodiment of the invention disclosed herein.
Figure 2:
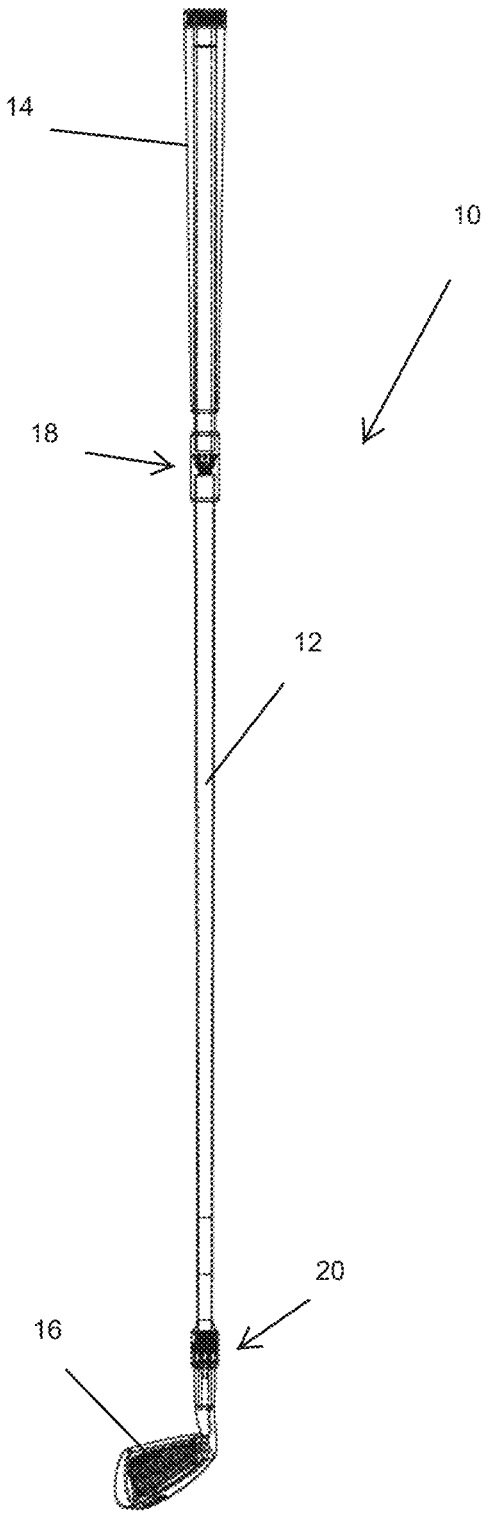
FIG. 2 is a hidden-line view of the golf club having a triune quick release assembly and connection illustrating the connection between the club shaft and the club grip and the club head.

The devices and methods discussed herein are merely illustrative of specific manners in which to make and use this invention and are not to be interpreted as limiting in scope.

While the invention has been described with a certain degree of particularity, it is to be noted that many modifications may be made in the details of the construction and the arrangement of the elements and components of the devices and/or in the sequences and steps of the methods without departing from the scope of this disclosure. It is understood that the devices and methods are not limited to the embodiments set forth herein for purposes of exemplification.

The description of the invention is intended to be read in connection with the accompanying drawings, which are to be considered part of the entire written description of this invention. In the description, relative terms such as "front," "rear," "lower," "upper," "horizontal," "vertical," "above," "below," "up," "down," "top," and "bottom" as well as derivatives thereof (e.g., "horizontally," "downwardly," "upwardly" etc.) should be construed to refer to the orientation as then described or as shown in the drawings under discussion. These relative terms are for convenience of description and do not require that the machine be constructed or the process to be operated in a particular orientation. Terms, such as "connected," "connecting," "attached," "attaching," "join," and "joining" are used interchangeably and refer to one structure or surface being secured to another structure or surface or integrally fabricated in one piece.

In general, the invention is directed to a triune quick release assembly and connection golf club system 10 having an improved assembly, disassembly, and connection between a club shaft 12 and a club grip 14 and/or a club head 16 that allows a golfer to quickly and easily change the club grip 14 and/or the club head 16. The triune quick release assembly and connection golf club system 10 is illustrated throughout the figures with the club head 16 as an iron, but is not so limited, and can also be constructed with a wood club head or with a putter club head. The triune quick release assembly and connection golf club system 10 may include a quick release connection 18 between the club shaft 12 and the club grip 14, and may also include a quick release connection 20 between the club shaft 12 and the club head 16.

Referring now to the figures of the drawings, wherein like numerals of reference designate like elements throughout the several views, the quick release connection 18 between the club shaft 12 and the club grip 14 may employ a tapered engagement insert 200 using a shape that prevents rotation when engaged. For example, the grip coupling 18 may use a tapered engagement insert 200 with a multi-conic shape. Similarly, the quick release connection 20 between the club shaft 12 and the club head 16 may employ a tapered engagement insert 202 using a shape that prevents rotation when engaged. For example, the head coupling 20 may use a tapered engagement insert 202 with a square taper. This combination of taper and shape may provide an optimized release angle to provide a low-effort detachment and reattachment of the club head and grip to the shaft and a zero-backlash, solid connection of components when connected, providing zero rotation when encountering large forces and vibrational modes associated with the club head striking the golf ball.

The connections 18 and 20 may be compact and form an oscillation-proof solid engagement with knurled finish on the outer shell 204 to provide the user a way to tighten the component onto the shaft 12 without requiring tools. The connections 18 and 20 may feature a multiple spring-loaded spherical ball engagement 206 that prevents counter-rotation of the threaded drawl-tight features, thus keeping the engagements secure during the high forces and vibrational modes the club experiences during swing and impact with the golf ball. This may provide a positive feedback tactile feel, with an audible clicking sound that guides the user to verify that the components are sufficiently tight and ready for use. The connections 18 and 20 may each further feature a compression disk 208 and slip ring 210 to set closure forces during assembly and provide rotational bearing for assembly and disassembly operations.

Figure 3:
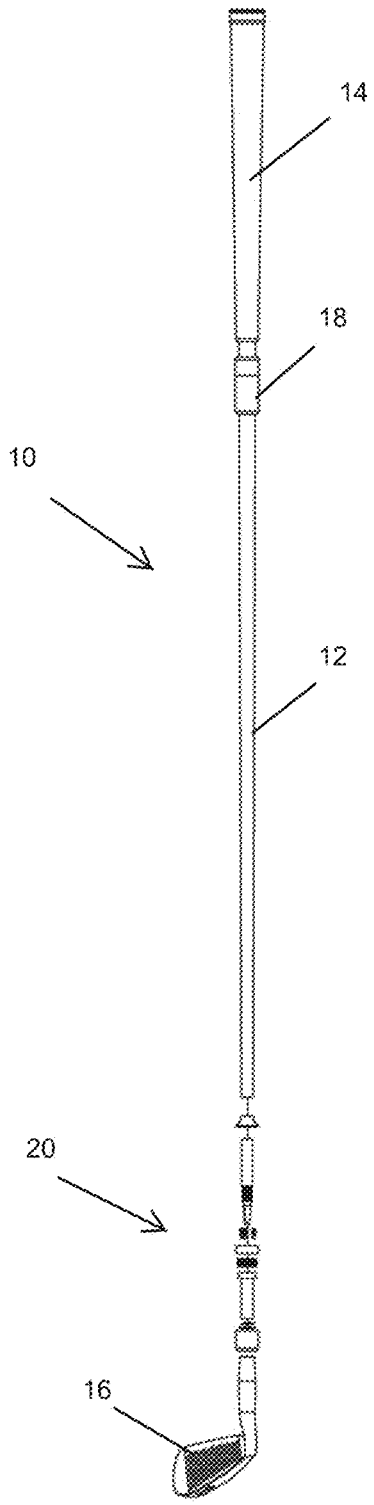
FIG. 3 is a partially exploded view of the golf club having a triune quick release assembly and connection illustrating the connection between the club shaft and the club head.
Figure 4:
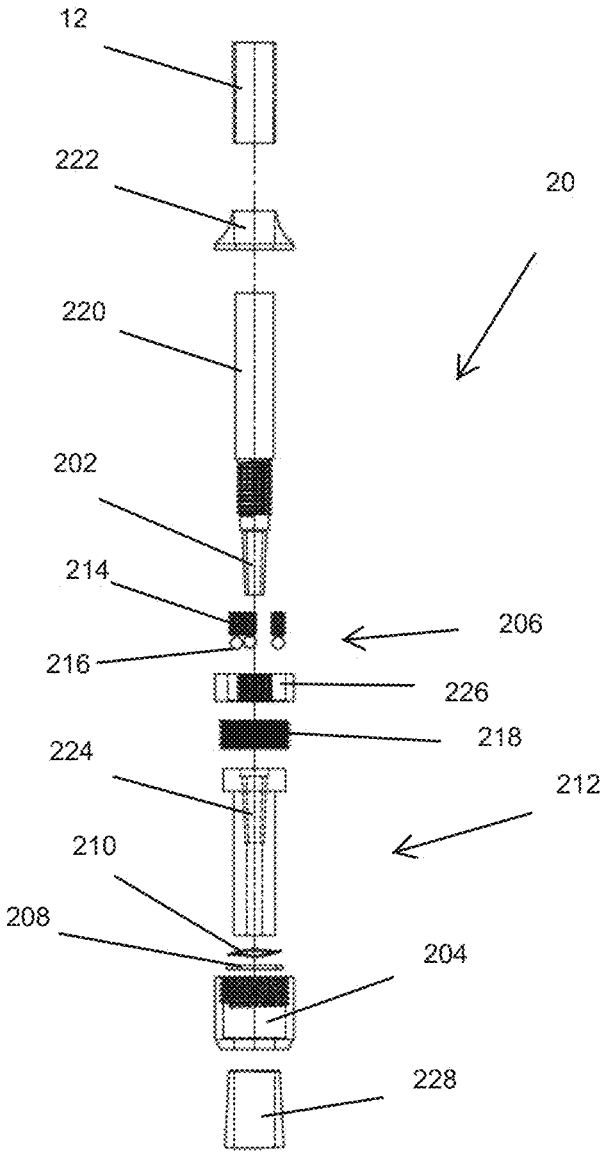
FIG. 4 is a close-up exploded view of the connection between the club shaft and club head shown in FIG. 3.

Specifically, regarding the shaft-to-head connection 20 as seen in FIGS. 3 and 4, the lower end of the shaft 12 may seat into a force spreading coupler 212 that also serves to capture the springs 214 and balls 216 inside the retainer ring 218. Post 220 may be bonded into shaft 12, and retainer ring 226 may thread onto post 220 to capture the springs 214 and balls 216 between the retainer ring 226 and shoulder 222. Shaft 12, shoulder 222, post 220, springs 214, balls 216, and retainer ring 226 may comprise the static lower portion of the shaft 12 as a unit. The square tapered end 202 of the post 220 may serve as a counter rotation, quick release, and high surface area locking mechanism. The post 220 and the corresponding socket 224 on the head-side may be key elements to the quick-release, the stiffness of the combined club-shaft interface, and the high precision, anti-rotational, and anti-vibration fitment of the head to shaft coupling.

The head-side components may comprise collar 218, socket 224, compression disk 208, slip ring 210, and locking ring 204. Socket 224 may have an interior that identically matches the square tapered end 202 of post 220, allowing the tapered end 202 of post 220 to be received within the socket 224 such that post 202 cannot rotate. Once engaged, locking ring 204 may be rotated until the socket 224 and post 220 are captured. This fitment process may engage balls 216 into detents on retaining ring 218, thus creating a tactile and audible clicking sound as the fitment is drawn tight. The retaining ring 218 and collar 226 may be locked from turning by balls 216. The compression disk 208 and slip ring 210 may provide a zero clearance fitment so that no vibrational modes can be present in the coupling of the post 202 to the socket 224.

The lower end of socket 224 may be sized to whatever diameter is needed to fit into the hosel 228 of any desired golf club head. The head may thus be attached using customary bonding methods, such as high sheer strength glass bead impregnated epoxy resin. The upper lip section of the socket 224 may be captured by the lower interior surface of locking ring 204, with the compression disk 208 and slip ring 210 in between. Collar 226 may be screwed into the locking ring 204 and permanently bonded.

Figure 5:
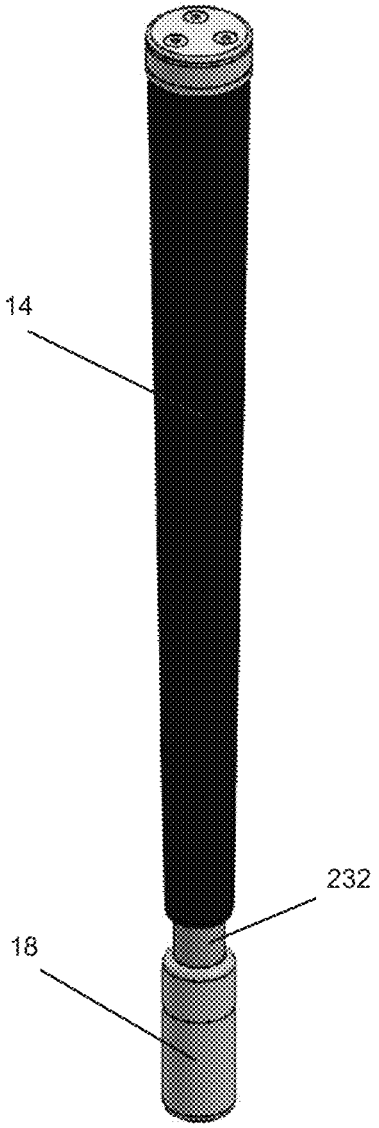
FIG. 5 is a close-up view of the club grip and the connection between the club shaft and the club grip.
Figure 6:
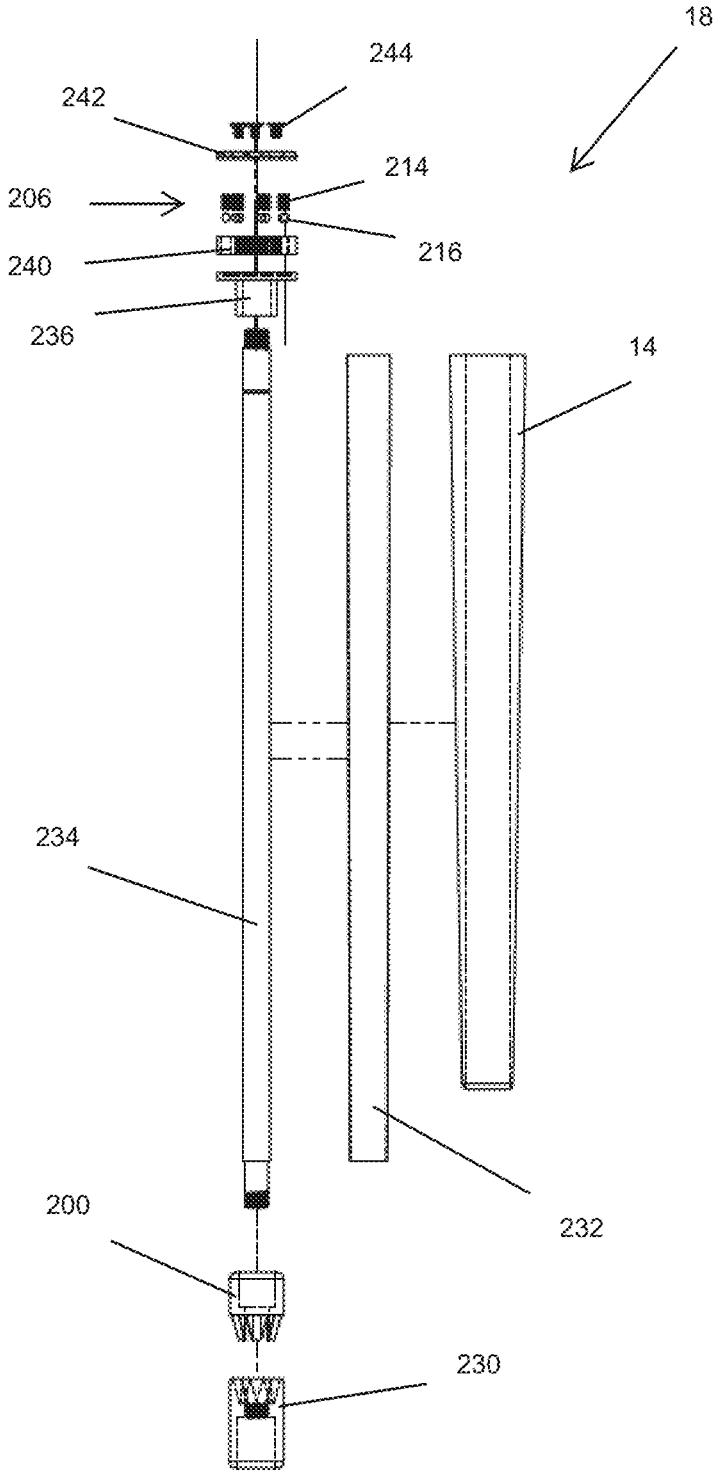
FIG. 6 is a close-up exploded view of the club grip and the connection between the club shaft and the club grip shown in FIG. 5.
Figure 7:
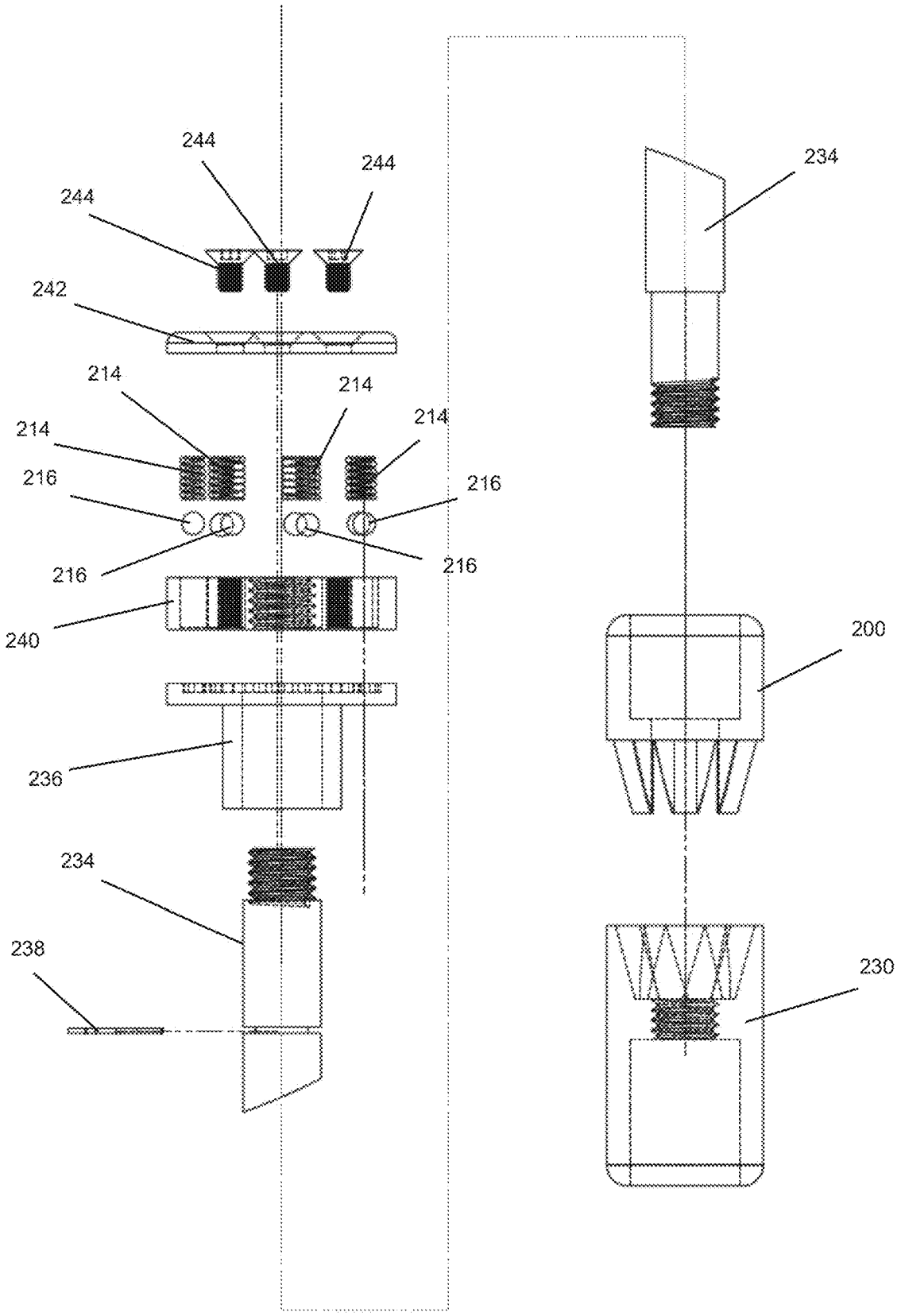
FIG. 7 is a further close-up view of the two ends of the connection between the club shaft and the club grip shown in FIG. 5.
Figure 8:
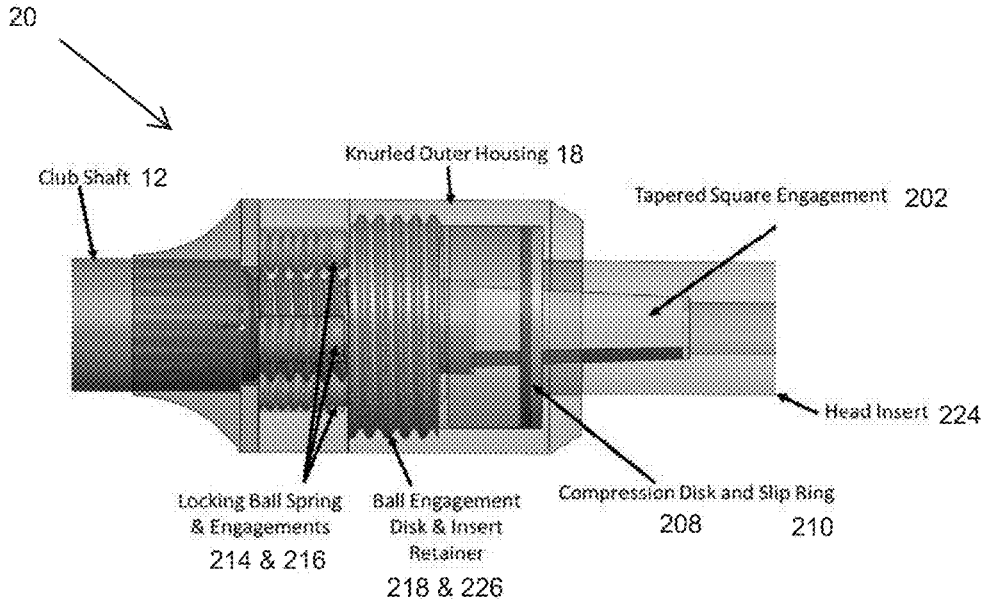
FIG. 8 is partial cutaway view of the connection between the club shaft and club head.
Figure 9:
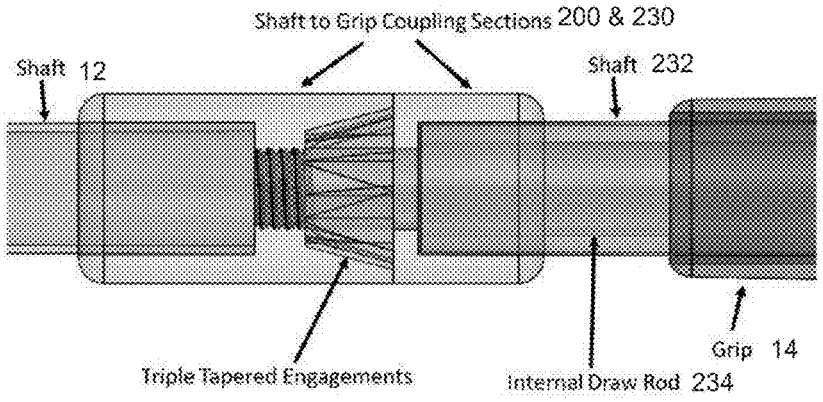
FIG. 9 a partial cutaway view of the lower end of the connection between the club shaft and the club head.
Figure 10:
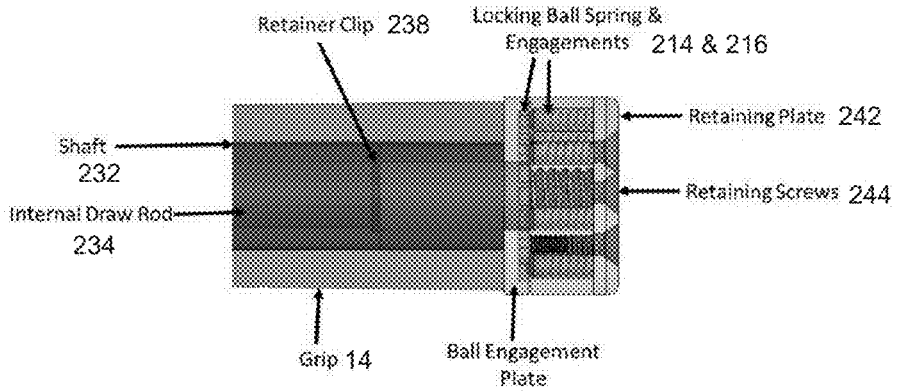
FIG. 10 is a partial cutaway view of the upper end of the connection between the club shaft and the club head.

Regarding the grip-to-shaft connection 18, as seen in FIGS. 5 through 7, the lower section of the grip-side engagement insert 200 may have multiple conical tapered shapes to prevent counter rotation and may provide a quick release and high surface area locking mechanism. This feature of the grip-side engagement insert 200 may fit into the mating inverse shape in the top of the shaft-side engagement piece 230. The opposite end of the shaft-side engagement piece may connect to the shaft 232. An internal draw rod 234 may be used to draw the two engagement pieces 200 and 230 together in a rigid coupling by means of a lower threaded section of the draw rod 234. The engagement pieces 200 and 230 may be key elements to the quick-release, stiffness of the combined grip-shaft interface, and the high precision, anti-rotational, and anti-vibration fitment of the grip to shaft coupling.

The grip to shaft rotating drive mechanism may be operated by the user to assemble or disassemble the grip section from the center shaft. The top section of the draw rod 234 may be passed through a coupler 236 and retained with a clip ring 238. Coupler 236 may serve to attach to the grip shaft 232 and may be bonded. Likewise, coupler 236 may contain detents on a top face that are capable of receiving multiple balls 216. The ball spring engagements 216 and 214 may be inserted into a rotational locking twist knob 240. The balls 216 and springs 214 may be captured into the rotational locking twist knob 240 and retained by an end plate 242, which may be held in place by screws 244.

A further aspect of the triune quick release assembly and connection golf club system 10 relates to marketing, selling, manufacturing, or utilizing one or more components of the golf club system 10 as a kit including a travel bag.

Whereas, the invention has been described in relation to the drawings and claims, it should be understood that other and further modifications, apart from those shown or suggested herein, may be made within the scope of this invention.

What is claimed is:

1. A triune quick release connection system for a golf club, the golf club comprising a club grip, a club head, and a club shaft intermediate of the club grip and the club head, the triune quick release connection system comprising:

a first quick release connection between an upper terminal end of the club shaft and a lower terminal end of the club grip, the first quick release connection comprising:
- a tapered engagement insert with a shape capable of preventing rotation when engaged;
- a spring-loaded spherical ball engagement; and
- a rotational locking twist knob; and a second quick release connection between a lower terminal end of the club shaft and a hosel of the club head, the second quick release connection comprising:
- a tapered engagement insert with a shape capable of preventing rotation when engaged;
- a spring-loaded spherical ball engagement; and
- a locking ring;

wherein the first quick release connection further comprises:
- a shaft-side engagement piece with a shape that is a mating inverse of the tapered engagement insert of the first quick release connection, where the shaft-side engagement piece is connected to the club shaft; and
- an internal draw rod with a lower threaded section capable of drawing the tapered engagement insert of the first quick release connection and the shaft-side engagement piece together.

2. The triune quick release connection system of claim 1 wherein the tapered engagement insert of the first quick release connection has a multi-conic shape.

3. The triune quick release connection system of claim 1 wherein the tapered engagement insert of the second quick release connection has a square shape.

4. The triune quick release connection system of claim 1 where the first quick release connection further comprises a coupler, where a top section of the internal draw rod is capable of passing through the coupler and being retained with a clip ring.

5. The triune quick release connection system of claim 4 wherein the spring-loaded spherical ball engagement of the second quick release connection comprises one or more springs and one or more balls and where the second quick release connection further comprises:
- detents in a top face of the coupler, where the detents are capable of receiving the one or more balls; and
- an end plate capable of retaining the one or more balls and the one or more springs within the rotational locking twist knob against the detents.

6. A triune quick release connection system for a golf club, the golf club comprising a club grip, a club head, and a club shaft intermediate of the club grip and the club head, the triune quick release connection system comprising:

a first quick release connection between an upper terminal end of the club shaft and a lower terminal end of the club grip, the first quick release connection comprising:

a tapered engagement insert with a shape capable of preventing rotation when engaged;

a spring-loaded spherical ball engagement; and a rotational locking twist knob; and a second quick release connection between a lower terminal end of the club shaft and a hosel of the club head, the second quick release connection comprising:

a tapered engagement insert with a shape capable of preventing rotation when engaged;

a spring-loaded spherical ball engagement; and a locking ring;

wherein the spring-loaded spherical ball engagement of the second quick release connection comprises one or more springs and one or more balls and where the second quick release connection further comprises:

a post bonded into the club shaft, where the post terminates in the tapered engagement insert;

a shoulder; and a retainer ring capable of being threaded onto the post to capture the one or more springs and the one or more balls between the retainer ring and the shoulder.

7. The triune quick release connection system of claim 6 wherein the second quick release connection further comprises:

a socket with an interior that corresponds to the tapered engagement insert of the post, such that the tapered engagement insert is capable of being received within the socket such that post cannot rotate;

the locking ring capable of being rotated until the socket and post are captured, such that the one or more balls are engaged into detents on the retainer ring and the one or more springs prevent the retaining ring from turning.

8. The triune quick release connection system of claim 7 wherein the second quick release connection further comprises a compression disk and slip ring.

9. The triune quick release connection system of claim 7 wherein the socket is bonded to the club head.

* * * * *